United States Patent [19]

Reifers et al.

[11] 4,298,156

[45] Nov. 3, 1981

[54] NESTABLE AND DENESTABLE MOLDED EGG CARTONS

[75] Inventors: Richard F. Reifers, New Canaan, Conn.; Henry A. Lord, Cape Elizabeth, Me.

[73] Assignee: Diamond International Corporation, New York, N.Y.

[21] Appl. No.: 161,621

[22] Filed: Jun. 20, 1980

[51] Int. Cl.[3] ..... B65D 21/02

[52] U.S. Cl. ..... 229/2.5 R; 229/2.5 EC; 229/45 EC; 229/44 EC; 217/26.5; 206/518; 206/519

[58] Field of Search ..... 206/518, 519; 229/2.5 R, 2.5 EC, 45 EC, 44 EC; 217/26.5

[56] References Cited

U.S. PATENT DOCUMENTS

| | | | |
|---|---|---|---|
| 3,185,370 | 5/1965 | Reifers et al. | 229/29 M |
| 3,539,552 | 11/1970 | Mounts et al. | 206/519 |
| 4,081,123 | 3/1978 | Reifers | 229/44 EC |

*Primary Examiner*—William Price

*Attorney, Agent, or Firm*—Karl W. Flocks

[57] ABSTRACT

Nestable multi-section hinged cartons having lobe formations extending into the carton ends which may act as a fulcrum acts so as to adjust into parallelism a slightly askew carton presented to a nest of similar cartons when the pressure of a subsequent carton is applied to the nest.

6 Claims, 8 Drawing Figures

NESTABLE AND DENESTABLE MOLDED EGG CARTONS

This invention relates to cartons and, more particularly, to cartons having a plurality of sections hingedly connected to each other. Such cartons may have a dished bottom section and an inverted dished cover section. More particularly, this invention relates to molded cartons and to molded egg cartons. The example of carton illustrated in the drawing is an open, nestable molded pulp egg carton having a flap hingedly connected to the cellular section and provided with molded buttons for cooperation with openings in a wall of the cover section. More specifically, this invention relates to the denestable structural formation incorporated in molded egg cartons.

BACKGROUND OF THE INVENTION

Prior to the instant invention, molded egg cartons have been produced from molds so that the rim of the inverted dished cover and the rim of the cellular section and the hinged flap are generally in the same plane. An example of such a prior carton is illustrated in the U.S. Pat. No. to Reifers and Lord, 3,185,370. Such prior cartons are adapted for use in automated egg packing systems.

When cartons of this general character are produced, they are nested in stacks which are packaged for shipment to egg packers, who have the task of denesting each carton so that each carton may be presented to an egg loader and then to a carton closer, and finally, the loaded, closed egg cartons are then packed into egg cases for shipment to the supermarket.

Prior egg cartons in stacks have been separated from each other by denesting ledges located at or around the corners of the cover section and the corners of the cellular sections. Such stacks of egg cartons have been presented to denesting apparatus and have been separated automatically for replacement on conveyors to receive eggs from automated egg loaders. In such prior systems using such prior egg cartons, a certain amount of downtime has been experienced due to the difficulty in separating the end egg carton from the stack because of what has been characterized as "telescoping". This objectionable "telescoping" occurs when the cover section of one carton, or the cellular section of one carton, overrides or partially overrides the denesting ledge of the corresponding portion of the adjacent carton in the stack.

This "telescoping" may occur at the time of nesting of the cartons when the stack is produced, or it may occur in the packaged stack during the course of shipment to the egg packer, as some settling occurs in the stack during shipment by rail or truck, and a single stack of egg cartons in a single package may have one or more incidences of "telescoping".

With the advent of higher and higher speeds of molded egg carton production, and correspondingly, higher speeds of nesting or stacking, the chance for the incidence of "telescoping" to occur is markedly increased. This incidence of "telescoping" occuring at the time of stacking takes place when the molded carton is presented to the stack in somewhat imprecise relationship, or with a departure from absolute parallelism so that a carton then may "telescope" when pressure is applied to the stack in the course of the packaging of the stack. It is known that the height of a stack may decrease during the course of shipment to the egg packer and when this decrease in height occurs coincidently with the presence of a slightly cocked egg carton, then "telescoping" may occur.

When "telescoping" occurs and appears in the stack in the plant of the egg packer, and the egg packer loads a stack with one or more incidences of "telescoping" into his denesting apparatus, a jam will occur during the operation of the automatic equipment resulting in shutdown of the denesting machine, the empty carton takeaway conveyor from the denesting machine, the automatic egg loader which serves to load the empty egg cartons, the automatic closer which closes the egg cartons, and the automatic egg case packer which packs the egg cases with closed and loaded egg cartons. Such shutdowns are costly and time consuming.

OBJECTS OF THE INVENTION

It is an object of the invention to produce a nestable and denestable egg carton which will be fail-safe or relatively fail-safe with respect to the incidence of "telescoping".

It is another object of the instant invention to provide a strong denesting ledge formation integral with the egg carton.

It is still another object of the instant invention to provide a denesting ledge structure which will not interfere with the operation of the denesting machine.

It is still another object of the invention to provide a denesting ledge formation involving a multi-lobe structure at and adjacent to the outside corners of the egg carton cover and the outside corners of the cellular section.

It is still another object of the instant invention to provide a denesting ledge formation including a relatively thick-walled lobe substantially entirely in the ends of the carton adjacent a lobe in the outside corners of the carton such that on the inner surface of the carton there is a generally vertical, substantially continuous wall surface between the lobes capable of directly transmitting vertical forces or directly supporting vertical loads.

It is still another object of the instant invention to provide a multi-lobe outside corner wherein a lobe in the end wall of a section is of a relatively narrow width as compared to the width of the adjacent lobe extending around an outside corner of the carton.

Other objects and the nature and advantages of the invention will be better understood by reference to the accompanying drawings.

Figure 1:
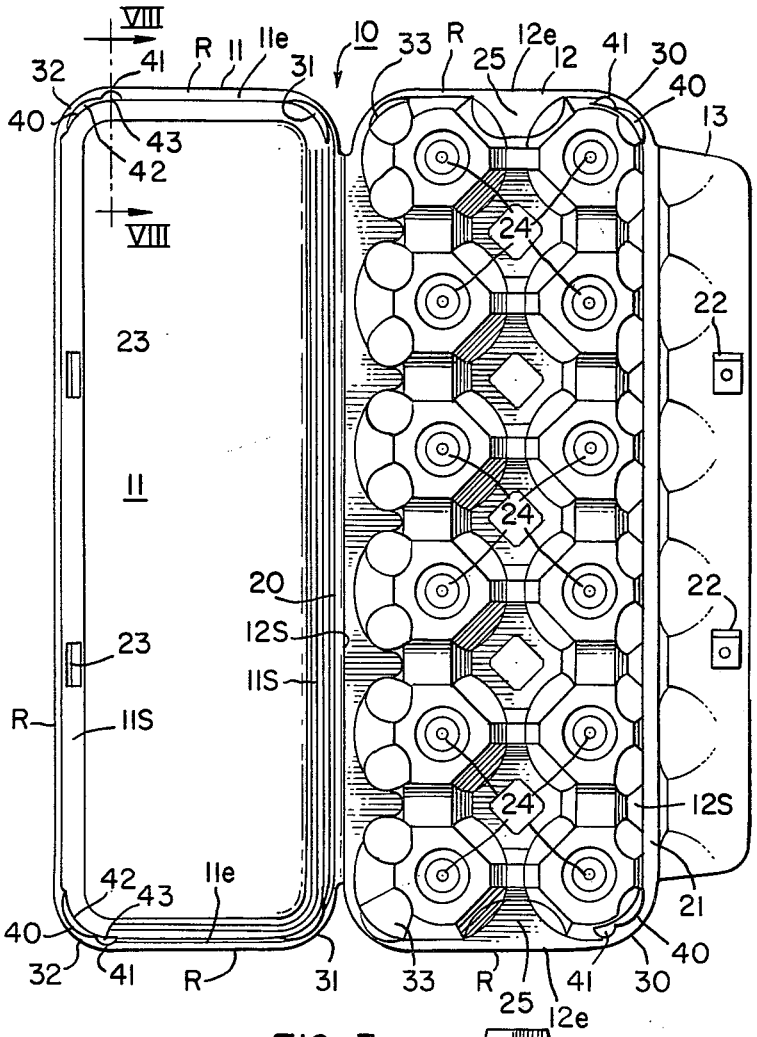
FIG. 1 is a plan view of an outside of an egg carton as it comes from the molding machine showing the denesting ledge formation at the two outside corners of the cover section and the two outside corners of the cellular section.

Referring to the drawings, the molded egg carton 10, as illustrated in FIG. 1 in bottom plan view, shows the cover section 11 connected to the cellular section 12 by the hinge line 20. The cellular section 12 is connected to the flap section 13 by the hinge line 21. The flap section 13 is provided with locking buttons 22 for cooperation with the locking holes 23 in the long front side wall of the inverted dished cover 11. The cellular section 12 is provided with egg cells 24.

Figure 5:
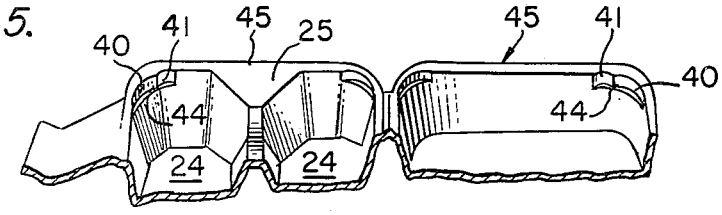
FIG. 5 is fragmentary view in perspective looking somewhat downwardly into the end of an egg cell section and the end of a cover section and illustrating the inner surface adjacent the denesting ledge formations.

The generally triangular plane section 25 is located between two cells 24 at each end 12*e* of the cellular section 12, as illustrated in FIGS. 1 and 5.

The cellular section 12 has two relatively long tapered sides 12*s* and two relatively short tapered ends 12*e* so as to form outside rounded corners 30 and inside rounded corners 33. The cover section 11 has two relatively long tapered sides 11*s* and two relatively short tapered ends 11*e* so as to form outside corners 32 and inside corners 31.

Figure 8:
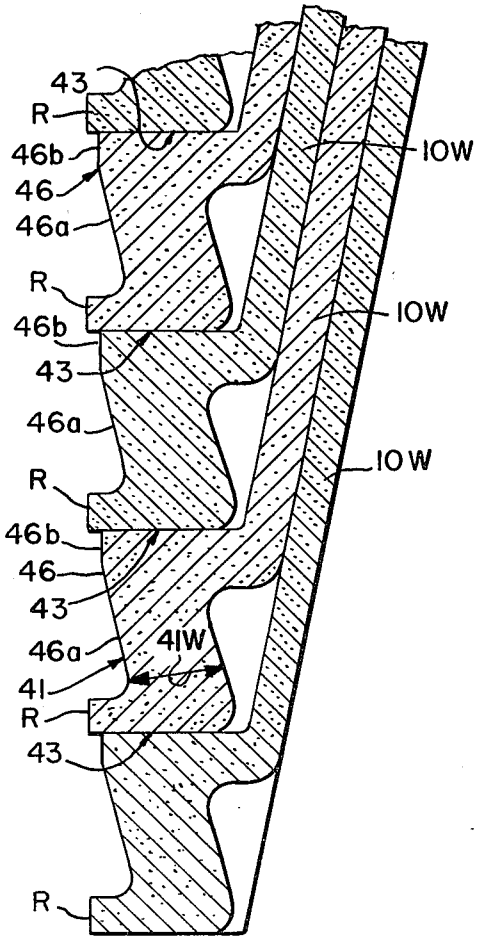
FIG. 8 is an enlarged fragmentary vertical section taken through a stack of cartons of the type illustrated in FIG. 1 along line VIII—VIII and looking in the direction of the arrows.

At the two outside rounded corners 30 and the two outside rounded corners 32, there is provided a multi-lobe denesting formation structure comprising relatively thick-walled and relatively narrow lobes 41 and relatively wide lobes 40. Each lobe 41 is provided with a ledge surface 43 and each lobe 40 is provided with a ledge surface 42. Referring to FIG. 8, the outer surface 46 of the wall of each of the lobes 41 adjacent the ledge surface 43 includes a surface 46*a* having a reverse taper as compared to the taper of the section ends 11*e* and 12*e* and a relatively short surface 46*b* having substantially no taper located between the surface 46*a* of reverse taper and the ledge surface 43.

The lobes 40 and 41 project outwardly from the carton and are hollow. Referring to FIG. 8, the wall thickness 41*w* of the lobe 41 is relatively great as compared with the thickness 10*w* of the main walls of the carton and as compared to the thickness of the rim which extends about the cover section and the rim which extends about the cellular section. As will be observed in FIG. 5, there is continuity of the vertical surface on the inside of the carton at 44 between the hollow lobe 40 and the hollow lobe 41.

The space extending inwardly from the lobes 41, designated by the reference numeral 45, at each end 11*e* of the cover section 11 and at each end 12*e* of the cellular section 12 is reserved for use by the element of a denesting machine so that there will be no interference between the denesting ledges and the operation of the denesting machine.

Figure 2:
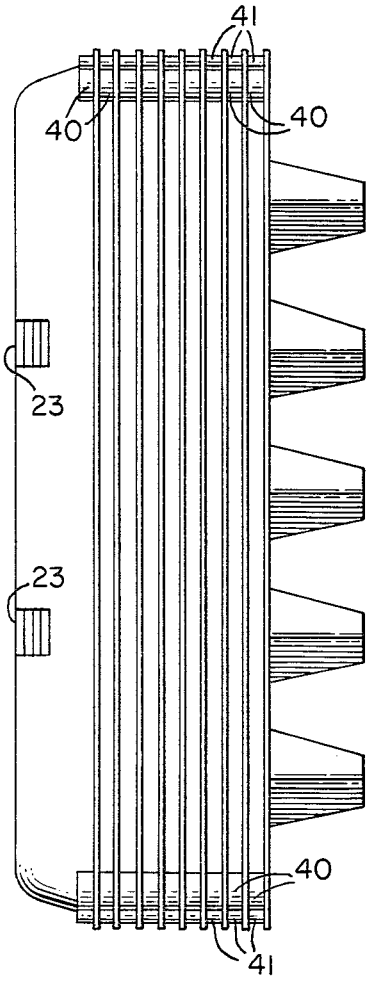
FIG. 2 is a view in side elevation of a partial stack of nested egg cartons of the type illustrated in FIG. 1.

FIG. 2 illustrates a partial stack of egg cartons in their nesting position as they are received from the egg carton production line.

Figure 3:
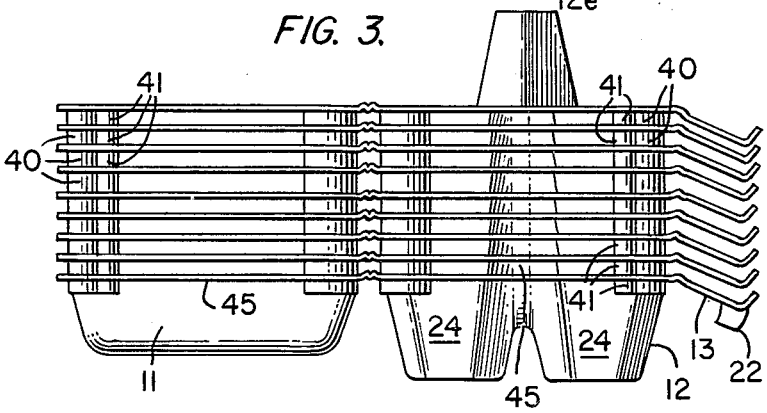
FIG. 3 is a view in end elevation of a stack of egg cartons illustrated in FIG. 2.

FIG. 3 illustrates a partial stack of egg cartons in the position that they are loaded in the denesting machine.

Figure 4:
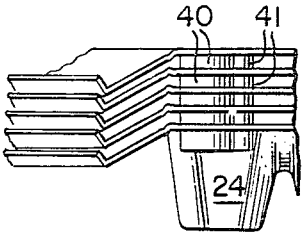
FIG. 4 is a fragmentary view in perspective showing a partial stack of nested egg cartons having denesting ledges and in relation to the outside corner of the cellular section and the adjacent egg carton flaps.

FIG. 4 is a fragmentary view in perspective illustrating a partial stack similar to the partial stack illustrated in FIG. 3, but turned at an angle so that the connection between the flap sections and the cellular sections are shown from a different angle. The fragmentary perspective view in FIG. 5 shows the inner surface of the portion of the egg carton 10 and the reverse hollow sides of the narrow lobe 41 and wide lobe 40 with the vertical surface 44 therebetween.

When the molded egg cartons are produced, they appear as illustrated in FIG. 1 with the peripheral rim R of the cover section 11, the peripheral rim R of the cellular section 12 and the outwardly extending flange section 13 generally in the same plane.

Figure 7:
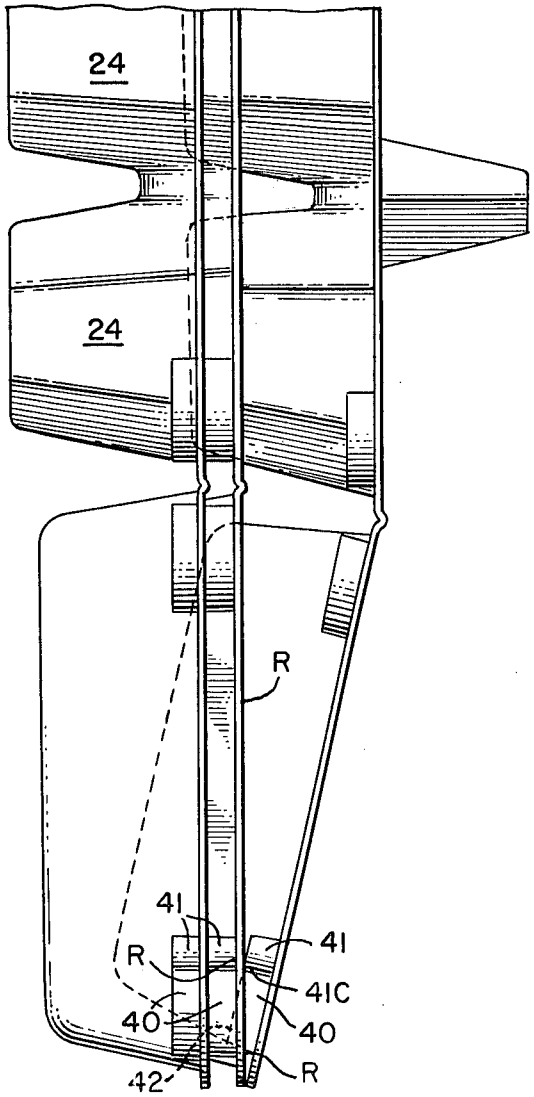
FIG. 7 is a view similar to FIG. 6 but looking directly down on the ends of the stack of cartons being formed showing the cover section of the last carton presented to the nest in cocked fashion while the hingedly connected cellular section of the last carton is in generally parallel relation to the already stacked cartons.
Figure 6:
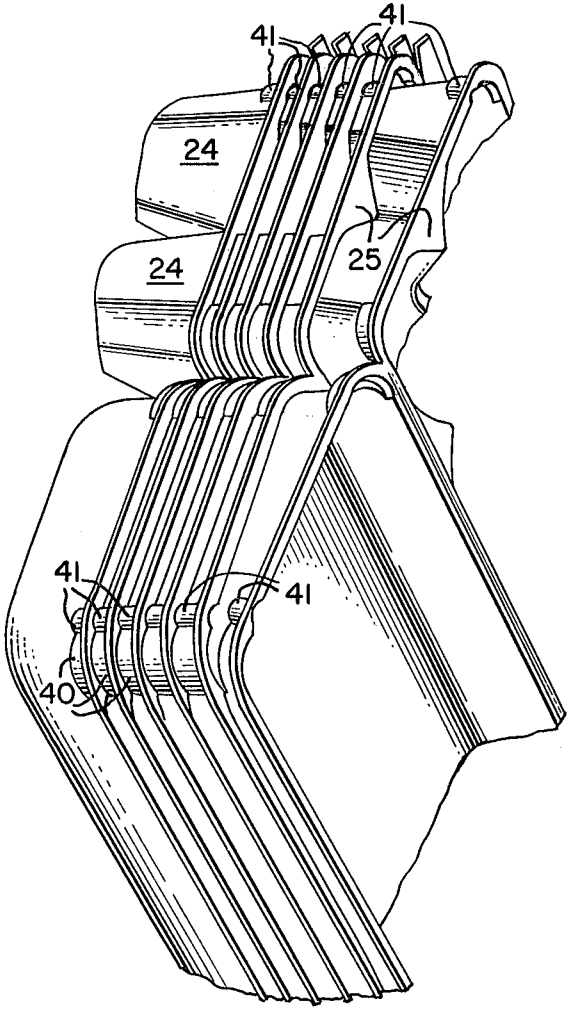
FIG. 6 is fragmentary view in perspective looking down from above and slightly to one side showing a stack of nested cartons being formed with the last carton presented to the nest in somewhat cocked fashion.

Automatic equipment running at very high speed nests the cartons as illustrated in FIG. 2. Due to the nature of the materials, the tolerances of the equipment, and the high operating speeds, the theoretical precise parallelism in the nesting step is not achieved for each and every one of the cartons nested. A small percentage of instances may occur in which nesting takes place with a slight departure from precise parallelism, as illustrated in FIG. 7. With prior constructions, such departure results in a tendency to "telescope" with the rim R of one carton tending to override the denesting ledge of a previously nested carton, as in FIG. 7. However, in accordance with the instant invention, when a next succeeding carton is applied to the nest, the pressure of this application will adjust the previous carton which may be slightly askew so that when the nest is completed, substantial parallelism is effected and the nest is substantially fail-safe and down-time due to telescoping is avoided. This adjustment takes place with pressure of the next succeeding carton application acting to partially rotate the somewhat askew carton to parallelism about the point of contact 41*c* of the narrow lobe 41, ledge 43 with the rim R of the already nested carton, the point of contact 41*c* acting as a pivot for this purpose.

Additional factors which provide the pressure to effect parallelism include compacting pressure which is applied to a freshly prepared stack during the carton packing operation and the settling which occurs during shipment of the packaged egg cartons to the egg packer.

Not only do relatively thick-walled and narrow lobes 41 serve to prevent telescoping or overriding of the wide lobes 40, but the lobes 41 also serve to make the wide lobes 40 finally effective when parallelism is achieved, as explained above, so that lobes 40 may carry their share of static load with the utilization of their relatively large bearing area on their ledge surfaces 42, while the lobes 41 carry their share of the static load on their relatively small bearing area on their ledge surfaces 43.

In accordance with the instant invention, the narrow lobes 41 in the ends 11*e* and 12*e* function to pivot an irregularly stacked carton to final perfect nesting interval and at the same time make effective the wide lobes 40, located at the corners of the carton, which would have otherwise been rendered ineffective.

Attempts to achieve the elimination of "telescoping" by widening the wide lobe 40 increase the line of connection between the ledge surface 42 and the egg carton. The longer the line of connection, the greater the chance for structural failure along the line. It will be observed that the line of connection between the lobe surface 43 of the thick-walled lobe 41 and the egg carton is very short and the vertical surface 44 between the lobes 40 and 41 provides for the transmission of stresses in a generally vertical direction. Accordingly, the invention accomplishes the substantial elimination of telescoping without increasing the chance of structural failure by widening the wide lobe 40.

It will be obvious to those skilled in the art that various changes may be made without departing from the scope of the invention and the invention is not to be considered limited to what is shown in the drawings and described in the specification.

What is claimed is:

1. In an open, nestable molded egg carton having an inverted dished four-cornered rectangular cover section hingedly connected to a four-cornered rectangular cellular section and wherein each of said sections has two relatively long tapered sides and two relatively short tapered ends and wherein the inside corners of said sections are adjacent their hinged connection and the outside corners are at the outer margins of the molded egg carton, a denestable structural formation comprising (a) a hollow first separating ledge located on and around each outside corner, (b) hollow discrete second separating ledges located entirely in said end walls substantially immediately adjacent said first separating ledges, (c) said second separating ledge being located outwardly from the center of said end walls, (d) the inner surface portion of said sections between said first and second ledges being substantially, or relatively, unbroken and generally continuous in a generally vertical direction.

2. The carton in accordance with claim 1, wherein the material of the carton is molded pulp and the outer surface of the carton corresponds generally to the surface of the mold and the inner surface of the carton is relatively rough or not as smooth and the hollow ledge formations, which extend outwardly of the outer surface of the carton are open to the inner surface.

3. The egg carton in accordance with claim 1 wherein the first separating ledge formation is a relatively wide lobe and the second separating ledge formation is a relatively narrow lobe.

4. A nested stack of cartons, each of which is in accordance with claim 1.

5. A packaged stack of nested cartons, each of which is in accordance with claim 1.

6. In an open, nestable molded carton having a first section having four rounded corners and hingedly connected to a second section having four rounded corners and wherein each of said sections has two relatively long tapered sides and two relatively short tapered ends and wherein the inside corners of said sections are adjacent their hinged connection and the outside corners are at the outer margins of the molded carton, (a) denesting structural multi-lobe formations on one of said sections with one lobe of each multi-lobe formation located entirely in the ends of said section and a second adjacent lobe located on the arc of the outside round corners of said section, (b) said lobe formation having denesting ledge surfaces extending outwardly from said tapered section ends, (c) the outer surfaces of the walls adjacent said ledge surfaces of each said one lobe in the ends including a surface having reverse taper as compared to the taper of section ends and a relatively short surface having substantially no taper located between the surface of reverse taper and the ledge surface, (d) the width of each said one lobe being substantially less than the width of the second lobe on the arc at the outside rounded corners.

* * * * *